US009335051B2

(12) United States Patent
Jarmon et al.

(10) Patent No.: US 9,335,051 B2
(45) Date of Patent: May 10, 2016

(54) CERAMIC MATRIX COMPOSITE COMBUSTOR VANE RING ASSEMBLY

(75) Inventors: David C. Jarmon, Kensington, CT (US); Peter G. Smith, Wallingford, CT (US)

(73) Assignee: United Technologies Corporation, Farmington, CT (US)

( * ) Notice: Subject to any disclaimer, the term of this patent is extended or adjusted under 35 U.S.C. 154(b) by 1104 days.

(21) Appl. No.: 13/181,898

(22) Filed: Jul. 13, 2011

(65) Prior Publication Data

US 2013/0014512 A1 Jan. 17, 2013

(51) Int. Cl.

| | |
|---|---|
| ***F23R 3/60*** | (2006.01) |
| ***F23R 3/16*** | (2006.01) |
| ***F01D 9/04*** | (2006.01) |
| ***F01D 5/28*** | (2006.01) |
| ***F01D 9/02*** | (2006.01) |
| ***F23R 3/00*** | (2006.01) |
| ***F23R 3/06*** | (2006.01) |

(52) U.S. Cl.

CPC . *F23R 3/16* (2013.01); *F01D 5/284* (2013.01); *F01D 9/023* (2013.01); *F01D 9/042* (2013.01); *F23R 3/002* (2013.01); *F23R 3/005* (2013.01); *F23R 3/06* (2013.01); *F23R 3/60* (2013.01); *F23M 2900/05002* (2013.01); *F23R 2900/00012* (2013.01); *F23R 2900/03042* (2013.01)

(58) Field of Classification Search

CPC ..... F23M 2900/05002; F23R 3/002; F23R 3/006; F23R 3/06; F23R 3/16; F23R 3/60; F23R 3/005; F23R 2900/00012; F23R 2900/03042; F01D 5/284; F01D 9/023; F01D 9/042

USPC ..... 415/135, 209.3; 416/225; 60/748, 752, 60/753, 800

See application file for complete search history.

(56) References Cited

U.S. PATENT DOCUMENTS

| | | | | |
|---|---|---|---|---|
| 3,767,322 | A * | 10/1973 | Durgin et al. | 416/97 R |
| 3,857,649 | A * | 12/1974 | Schaller et al. | 415/200 |
| 3,864,056 | A * | 2/1975 | Gabriel et al. | 415/178 |
| 3,887,299 | A | 6/1975 | Profant | |
| 4,008,978 | A | 2/1977 | Smale | |

(Continued)

FOREIGN PATENT DOCUMENTS

| | | |
|---|---|---|
| EP | 1445537 A2 | 8/2004 |
| EP | 2412929 A1 | 2/2012 |

(Continued)

OTHER PUBLICATIONS

Dunlap, Jr. et al.,"Toward an Improved Hypersonic Engine Seal" (2003), AIAA, AIAA 2003-4834.*

(Continued)

*Primary Examiner* — William H Rodriguez
*Assistant Examiner* — Jason H Duger
(74) *Attorney, Agent, or Firm* — Bachman & LaPointe, P.C.

(57) ABSTRACT

A vane assembly has an outer support ring, an inner support ring, an outer liner ring, an inner liner ring, and a circumferential array of vanes. Each vane has a shell extending from an inboard end to an outboard end and at least partially through an associated aperture in the inner liner ring and an associated aperture in the outer liner ring. There is at least one of: an outer compliant member compliantly radially positioning the vane; and an inner compliant member compliantly radially positioning the vane.

22 Claims, 5 Drawing Sheets

(56) References Cited

U.S. PATENT DOCUMENTS

| | | | | |
|---|---|---|---|---|
| 4,126,405 | A | 11/1978 | Bobo et al. | |
| 4,245,954 | A | 1/1981 | Glenn | |
| 4,363,208 | A | 12/1982 | Hoffman et al. | |
| 4,398,866 | A | 8/1983 | Hartel et al. | |
| 4,573,320 | A | 3/1986 | Kralick | |
| 4,626,461 | A | 12/1986 | Prewo et al. | |
| 4,759,687 | A | 7/1988 | Miraucourt et al. | |
| 4,920,742 | A * | 5/1990 | Nash et al. | 60/799 |
| 5,092,737 | A | 3/1992 | Lau | |
| 5,161,806 | A * | 11/1992 | Balsells | 277/383 |
| 5,299,914 | A | 4/1994 | Schilling | |
| 5,392,596 | A | 2/1995 | Holsapple et al. | |
| 5,466,122 | A | 11/1995 | Charbonnel et al. | |
| 5,511,940 | A * | 4/1996 | Boyd | 415/209.2 |
| 5,630,700 | A * | 5/1997 | Olsen et al. | 415/134 |
| 6,000,906 | A | 12/1999 | Draskovich | |
| 6,042,315 | A | 3/2000 | Miller et al. | |
| 6,045,310 | A | 4/2000 | Miller et al. | |
| 6,164,903 | A * | 12/2000 | Kouris | 415/135 |
| 6,197,424 | B1 | 3/2001 | Morrison et al. | |
| 6,200,092 | B1 | 3/2001 | Koschier | |
| 6,241,471 | B1 | 6/2001 | Herron | |
| 6,250,883 | B1 | 6/2001 | Robinson et al. | |
| 6,325,593 | B1 | 12/2001 | Darkins, Jr. et al. | |
| 6,451,416 | B1 | 9/2002 | Holowczak et al. | |
| 6,514,046 | B1 | 2/2003 | Morrison et al. | |
| 6,543,996 | B2 * | 4/2003 | Koschier | 415/200 |
| 6,648,597 | B1 | 11/2003 | Widrig et al. | |
| 6,668,559 | B2 * | 12/2003 | Calvez et al. | 60/796 |
| 6,675,585 | B2 * | 1/2004 | Calvez et al. | 60/796 |
| 6,676,373 | B2 | 1/2004 | Marlin et al. | |
| 6,679,062 | B2 * | 1/2004 | Conete et al. | 60/796 |
| 6,696,144 | B2 | 2/2004 | Holowczak et al. | |
| 6,708,495 | B2 * | 3/2004 | Calvez et al. | 60/753 |
| 6,709,230 | B2 | 3/2004 | Morrison et al. | |
| 6,732,532 | B2 * | 5/2004 | Camy et al. | 60/796 |
| 6,733,233 | B2 | 5/2004 | Jasklowski et al. | |
| 6,746,755 | B2 | 6/2004 | Morrison et al. | |
| 6,758,386 | B2 | 7/2004 | Marshall et al. | |
| 6,758,653 | B2 | 7/2004 | Morrison | |
| 6,808,363 | B2 | 10/2004 | Darkins, Jr. et al. | |
| 6,823,676 | B2 * | 11/2004 | Conete et al. | 60/796 |
| 6,854,738 | B2 | 2/2005 | Matsuda et al. | |
| 6,884,030 | B2 * | 4/2005 | Darkins et al. | 415/191 |
| 6,893,214 | B2 | 5/2005 | Alford et al. | |
| 6,910,853 | B2 | 6/2005 | Corman et al. | |
| 6,935,836 | B2 | 8/2005 | Ress, Jr. et al. | |
| 7,090,459 | B2 | 8/2006 | Bhate et al. | |
| 7,093,359 | B2 | 8/2006 | Morrison et al. | |
| 7,094,027 | B2 | 8/2006 | Turner et al. | |
| 7,114,917 | B2 | 10/2006 | Legg | |
| 7,117,983 | B2 | 10/2006 | Good et al. | |
| 7,134,287 | B2 * | 11/2006 | Belsom et al. | 60/800 |
| 7,153,096 | B2 | 12/2006 | Thompson et al. | |
| 7,198,454 | B2 | 4/2007 | Evans | |
| 7,198,458 | B2 | 4/2007 | Thompson | |
| 7,234,306 | B2 * | 6/2007 | Aumont et al. | 60/796 |
| 7,237,387 | B2 * | 7/2007 | Aumont et al. | 60/796 |
| 7,237,388 | B2 * | 7/2007 | Aumont et al. | 60/796 |
| 7,247,003 | B2 | 7/2007 | Burke et al. | |
| 7,249,462 | B2 * | 7/2007 | Aumont et al. | 60/796 |
| 7,278,830 | B2 | 10/2007 | Vetters | |
| 7,326,030 | B2 * | 2/2008 | Albrecht et al. | 415/115 |
| 7,384,240 | B2 | 6/2008 | McMillan et al. | |
| 7,434,670 | B2 | 10/2008 | Good et al. | |
| 7,435,058 | B2 | 10/2008 | Campbell et al. | |
| 7,445,426 | B1 * | 11/2008 | Matheny et al. | 415/135 |
| 7,452,182 | B2 | 11/2008 | Vance et al. | |
| 7,452,189 | B2 | 11/2008 | Shi et al. | |
| 7,488,157 | B2 | 2/2009 | Marini et al. | |
| 7,491,032 | B1 | 2/2009 | Powell et al. | |
| 7,497,662 | B2 | 3/2009 | Mollmann et al. | |
| 7,510,379 | B2 | 3/2009 | Marusko et al. | |
| 7,534,086 | B2 | 5/2009 | Mazzola et al. | |
| 7,546,743 | B2 | 6/2009 | Bulman et al. | |
| 7,600,970 | B2 | 10/2009 | Bhate et al. | |
| 7,647,779 | B2 | 1/2010 | Shi et al. | |
| 7,648,336 | B2 | 1/2010 | Cairo | |
| 7,665,960 | B2 | 2/2010 | Shi et al. | |
| 7,726,936 | B2 | 6/2010 | Keller et al. | |
| 7,753,643 | B2 | 7/2010 | Gonzalez et al. | |
| 7,762,768 | B2 | 7/2010 | Shi et al. | |
| 7,771,160 | B2 | 8/2010 | Shi et al. | |
| 7,785,076 | B2 | 8/2010 | Morrison et al. | |
| 7,824,152 | B2 | 11/2010 | Morrison | |
| 2005/0158171 | A1 | 7/2005 | Carper et al. | |
| 2005/0254942 | A1 | 11/2005 | Morrison et al. | |
| 2007/0072007 | A1 | 3/2007 | Carper et al. | |
| 2008/0034759 | A1 | 2/2008 | Bulman et al. | |
| 2008/0209726 | A1 * | 9/2008 | Powers | 29/889.1 |
| 2010/0021290 | A1 | 1/2010 | Schaff et al. | |
| 2010/0032875 | A1 | 2/2010 | Merrill et al. | |
| 2010/0111678 | A1 | 5/2010 | Habarou et al. | |
| 2010/0226760 | A1 | 9/2010 | McCaffrey | |
| 2010/0237565 | A1 * | 9/2010 | Foster | 277/377 |
| 2010/0257864 | A1 | 10/2010 | Prociw et al. | |
| 2011/0008156 | A1 | 1/2011 | Prentice et al. | |
| 2011/0027098 | A1 | 2/2011 | Noe et al. | |
| 2011/0052384 | A1 | 3/2011 | Shi et al. | |

FOREIGN PATENT DOCUMENTS

| | | | | |
|---|---|---|---|---|
| GB | 2048393 | A * | 12/1980 | F01D 9/02 |
| GB | 2250782 | A | 6/1992 | |
| WO | 2010146288 | A1 | 12/2010 | |

OTHER PUBLICATIONS

Paquette et al., "Hypersonic Airframe and Propulsion Seal Preload Device Development for 2300° F. Service" (2004), AIAA, AIAA 2004-3888.*

Oswald et al., "Modeling of Canted Coil Springs and Knitted Spring Tubes as High Temperature Seal Preload Devices" (2005), AIAA, AIAA 2005-4156.*

Soler et al., "Geometrical characterization of canted coil springs" (2006), Proceedings of the Institution of Mechanical Engineers, vol. 220 Part C, pp. 1831-1841.*

Characterization of First-Stage Silicon Nitride Components After Exposure to an Industrial Gas Turbine H.-T. Lin,*,M. K. Ferber,* and P. F. Becher, J. R. Price, M. van Roode, J. B. Kimmel, and O. D. Jimenez J. Am. Ceram. Soc., 89 [1] 258-265 (2006).

Evaluation of Mechanical Stability of a Commercial Sn88 Silicon Nitride at Intermediate Temperatures Hua-Tay Lin,* Mattison K. Ferber,* and Timothy P. Kirkland*, J. Am. Ceram. Soc., 86 [7] 1176-81 (2003).

Research and Development of Ceramic Turbine Wheels, K. Watanab, M. Masuda T. Ozawa, M. Matsui, K. Matsuhiro, 36 I vol. 115, Jan. 1993, Transactions of the ASME.

A.L. Neuburger and G. Carrier, Design and Test of Non-rotating Ceramic Gas Turbine Components, ASME Turbo Expo 1988, ASME paper 88-GT-146.

Vedula, V., Shi, J., Liu, S., and Jarmon, D. "Sector Rig Test of a Ceramic Matrix Composite (CMC) Combustor Liner", GT2006-90341, Proceedings of GT2006, ASME turbo Expo 2006: Power for Land, Sea and Air, Barcelona, Spain, May 8-11, 2006.

Bhatia, T., "Enabling Technologies for Hot Section Components", Contract N00014-06-C-0585, Final Report, Jan. 30, 2009.

Vedula, V., et al., "Ceramic Matrix Composite Turbine Vanes for Gas Turbine Engines", ASME Paper GT2005-68229, Proceedings of ASME Turbo Expo 2005, Reno, Nevada, Jun. 6-9, 2005.

Verrilli, M., Calamino, A., Robinson, R.C., and Thomas, D.J., "Ceramic Matrix Composite Vane Subelement Testing in a Gas Turbine Environment", Proceedings of ASME Turbo Expo 2004, Power for Land, Sea, and Air, Jun. 14-17, 2004, Vienna, ASME Paper GT2004-53970.

Watanbe, K., Suzumura, N., Nakamura, T., Murata, H., Araki, T., and Natsumura, T., "Development of CMC Vane for Gas Turbine Engine", Ceramic Engineering and Science Proceedings, vol. 24, Issue 4, 2003, pp. 599-604.

(56) References Cited

OTHER PUBLICATIONS

Calamino, A. and Verrilli, M., "Ceramic Matrix Composite Vane Subelement Fabrication", Proceedings of ASME Turbo Expo 2004, Power for Land, Sea, and Air, Jun. 14-17, 2004, Vienna, ASME Paper GT2004-53974.

Bhatia, T., et al., "CMC Combustor Line Demonstration in a Small Helicopter Engine", ASME Turbo Expo 2010, Glasgow, UK, Jun. 14-18, 2010.

European Search Report for European Patent Application No. 12175781.9, dated Feb. 2, 2013.

* cited by examiner

CERAMIC MATRIX COMPOSITE COMBUSTOR VANE RING ASSEMBLY

BACKGROUND

The disclosure relates to turbine engine combustors. More particularly, the disclosure relates to vane rings.

Ceramic matrix composite (CMC) materials have been proposed for various uses in high temperature regions of gas turbine engines.

US Pregrant Publication 2010/0257864 of Prociw et al. discloses CMC use in duct portions of an annular reverse flow combustor. US Pregrant Publication 2009/0003993 of Prill et al. discloses CMC use in vanes.

SUMMARY

One aspect of the disclosure involves a combustor/vane assembly having an outer support ring (e.g., metallic), an inner support ring (e.g., metallic), an outer liner ring (e.g., CMC), an inner liner ring (e.g., CMC), and a circumferential array of vanes. Each vane has a shell (e.g., CMC) extending from an inboard end to an outboard end and at least partially through an associated aperture in the inner liner ring and an associated aperture in the outer liner ring. There is at least one of: an outer compliant member compliantly radially positioning the vane; and an inner compliant member compliantly radially positioning the vane.

In various implementations, the outer compliant member may be between the outboard end and the outer support ring; and the inner compliant member may be between the inboard end and the inner support ring. Each vane may further comprise a tensile member extending through the shell and coupled to the outer support ring and inner support ring to hold the shell under radial compression. Each tensile member may comprise a rod extending through associated apertures in the outer support ring and inner support ring. Each inner compliant member or outer compliant member may comprise a canted coil spring. Each canted coil spring may lack a seal body energized by the spring. Each canted coil spring may be at least partially received in a recess in the inner support ring or outer support ring.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
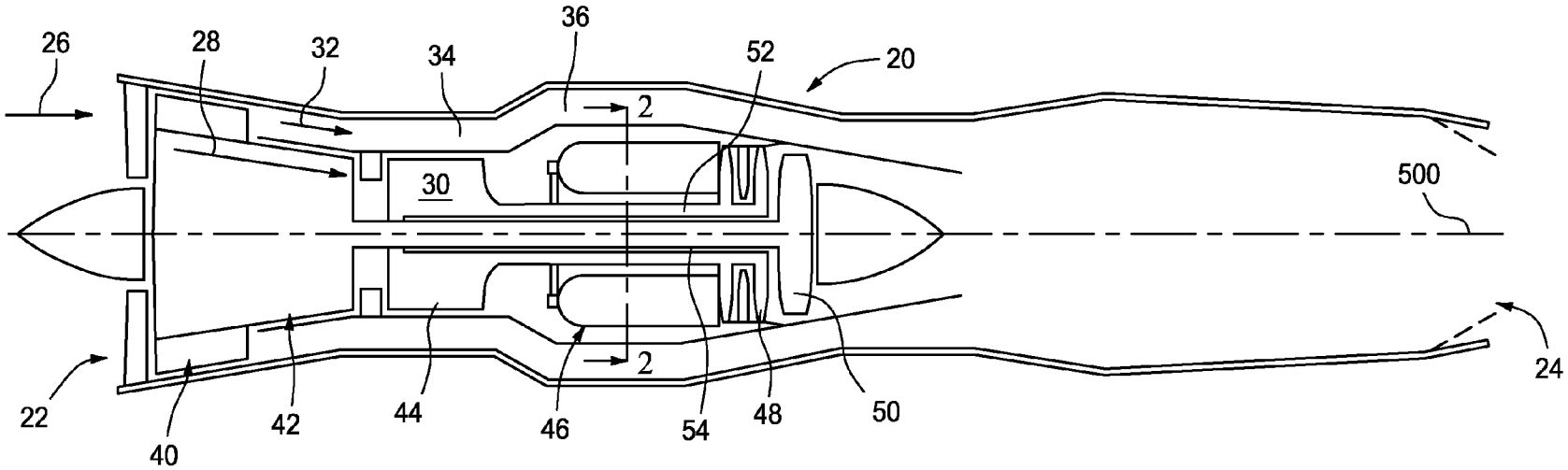
FIG. 1 is a partially schematic axial sectional/cutaway view of a gas turbine engine.

FIG. 1 shows a gas turbine engine 20. An exemplary engine 20 is a turbofan having a central longitudinal axis (centerline) 500 and extending from an upstream inlet 22 to a downstream outlet 24. In a turbofan engine, an inlet air flow 26 is divided/split into a core flow 28 passing through a core flowpath 30 of the engine and a bypass flow 32 passing along a bypass flowpath 34 through a duct 36.

The turbofan engine has an upstream fan 40 receiving the inlet air flow 26. Downstream of the fan along the core flowpath 30 are, in sequential order: a low pressure compressor (LPC) section 42; a high pressure compressor (HPC) section 44; a combustor 46; a gas generating turbine or high pressure turbine (HPT) section 48; and a low pressure turbine (LPT) section 50. Each of the LPC, HPC, HPT, and LPT sections may comprise one or more blade stages interspersed with one or more vane stages. The blade stages of the HPT and HPC are connected via a high pressure/speed shaft 52. The blade stages of the LPT and LPC are connected via a low pressure/speed shaft 54 so that the HPT and LPT may, respectively, drive rotation of the HPC and LPC. In the exemplary implementation, the fan 40 is also driven by the LPT via the shaft 54 (either directly or via a speed reduction mechanism such as an epicyclic transmission (not shown)).

The combustor 46 receives compressed air from the HPC which is mixed with fuel and combusted to discharge hot combustion gases to drive the HPT and LPT. The exemplary combustor is an annular combustor which, subject to various mounting features and features for introduction of fuel and air, is generally formed as a body of revolution about the axis 500.

Figure 2:
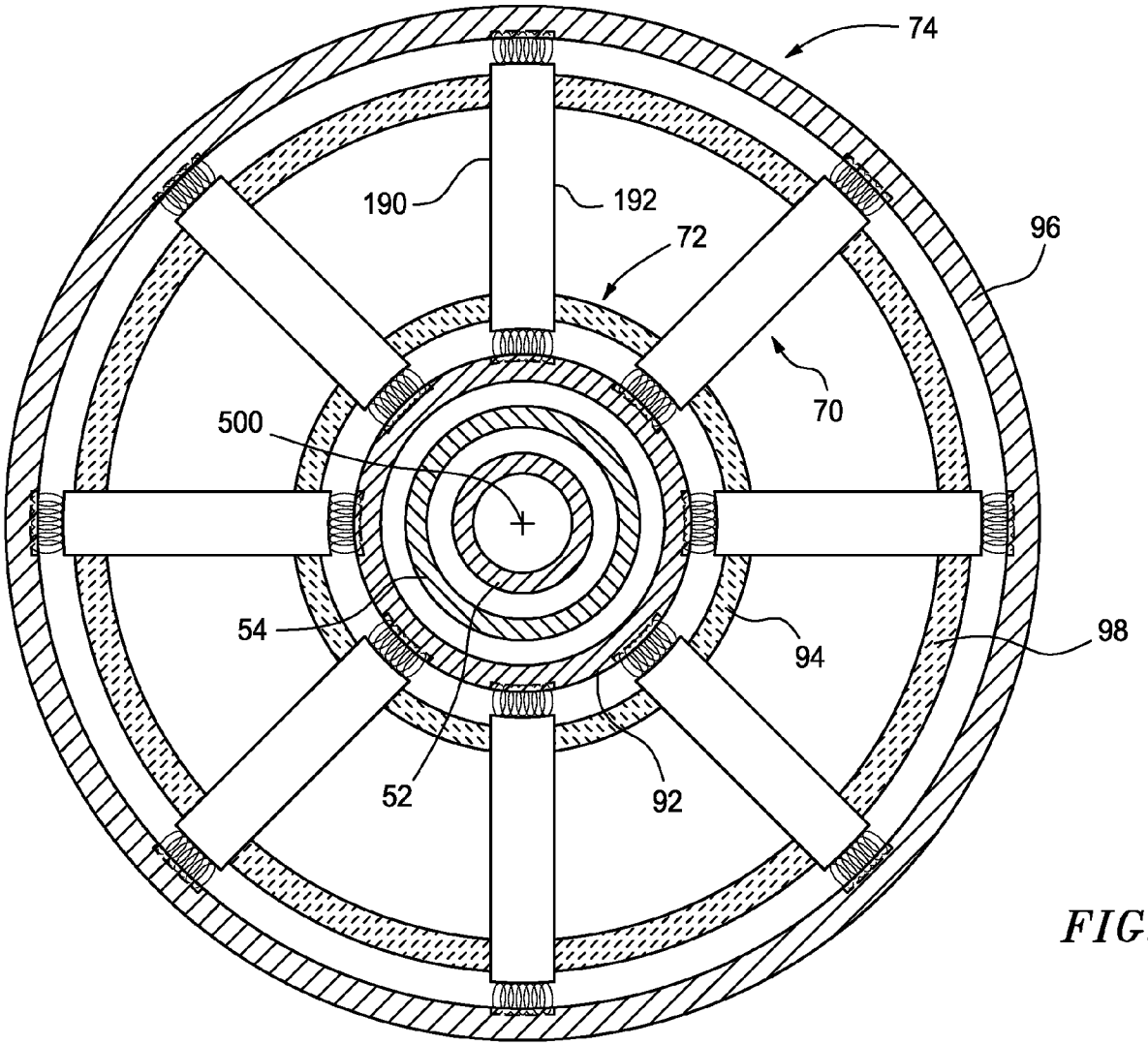
FIG. 2 is a transverse sectional view of the combustor of the engine of FIG. 1, taken along line 2-2.
Figure 3:
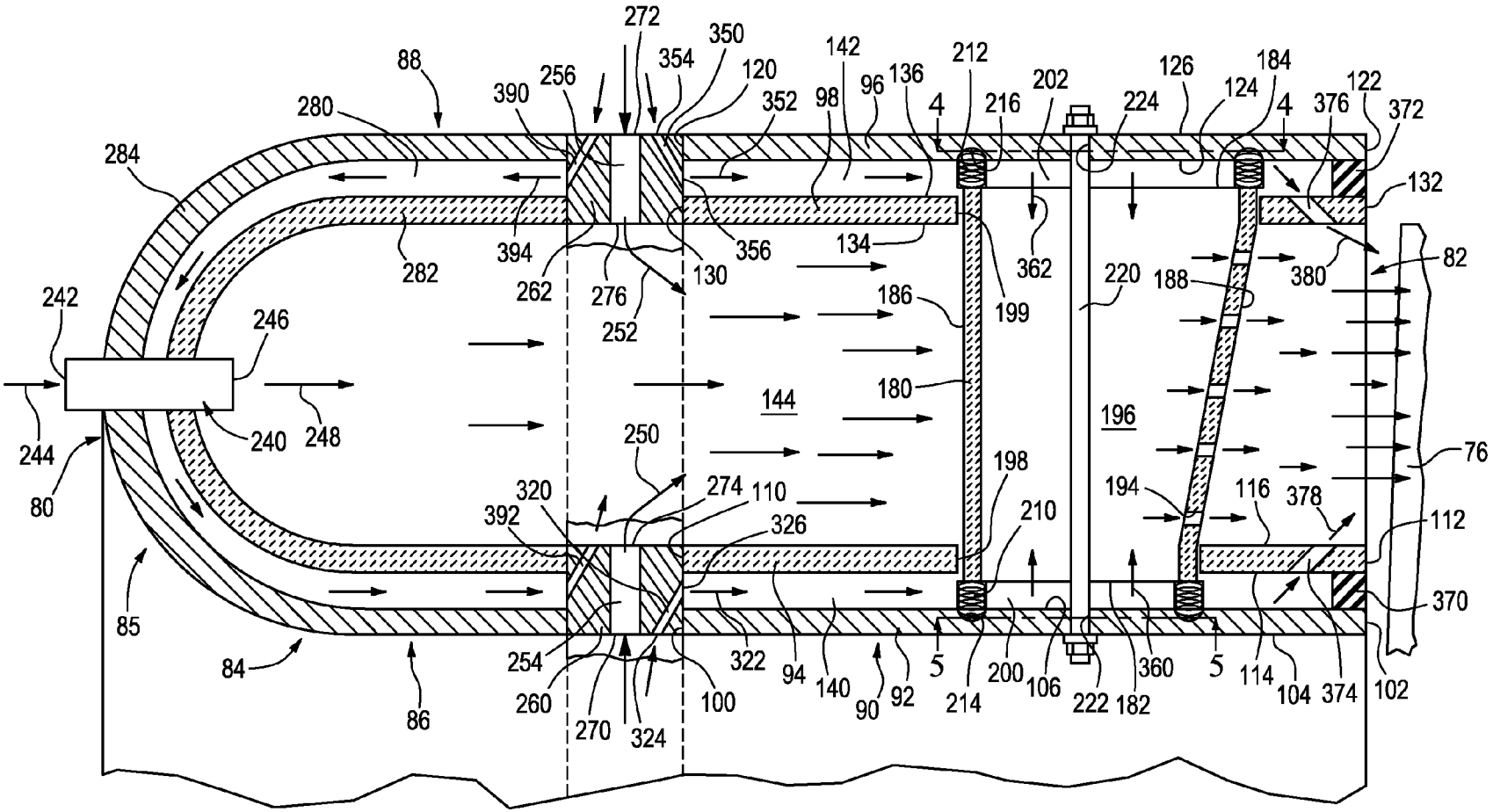
FIG. 3 is an enlarged view of the combustor of FIG. 1.
Figure 4:
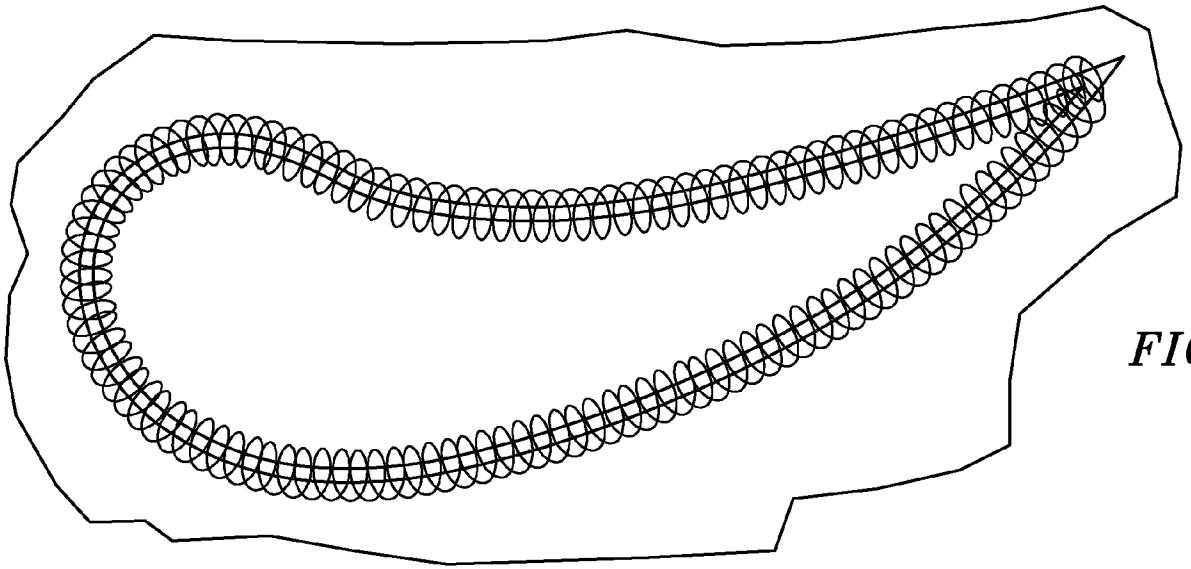
FIG. 4 is a radially inward sectional view of the combustor of FIG. 3.
Figure 5:
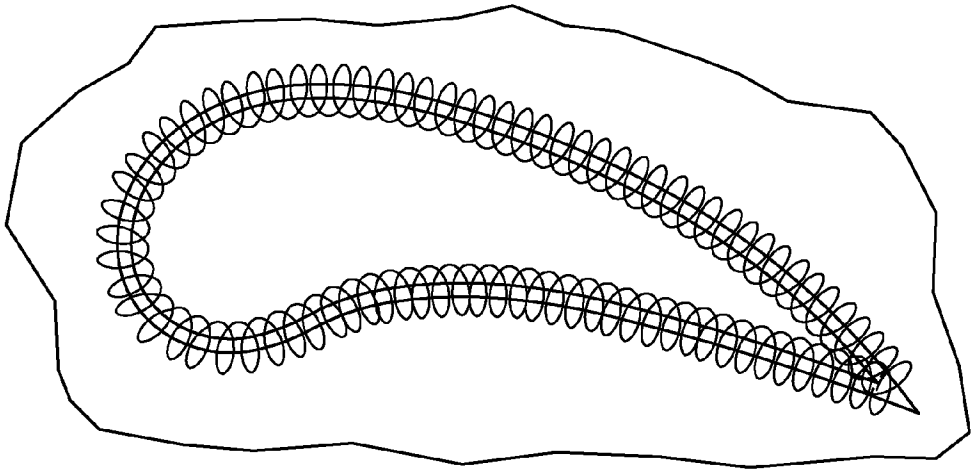
FIG. 5 is a radially outward sectional view of the combustor of FIG. 3.

FIG. 2 shows the combustor as including a circumferential array of vanes 70. As is discussed below, the vanes 70 may be used to turn the combustion gas stream so that it contacts the turbine first stage blades at the proper angle. Exemplary vanes 70 extend generally radially between an inboard (radially) wall structure 72 and an outboard (radially) wall structure 74. As is discussed below, each of the exemplary wall structures 72 and 74 are double-layered with an inner layer (facing the combustor main interior portion/volume) and an outer layer. FIG. 3 also shows the first stage of blades 76 of the HPT immediately downstream of the vanes 70 (i.e., in the absence of intervening vanes). Relative to an exemplary baseline system, this may effectively move the baseline first turbine vane stage upstream into the combustion zone as the array of vanes 70. Whereas the baseline would need sufficient length so that combustion is completed before encountering the vanes, the forward shift allows for a more longitudinally compact and lighter weight configuration. As is discussed below, the exemplary combustor is a rich burn-quench-lean burn (RQL) combustor. The vanes 70 fall within the lean burn zone.

FIG. 3 shows the combustor 46 as extending from an inlet end 80 to an outlet end 82. A double layered annular dome structure 84 forms an upstream bulkhead 85 at the inlet end and upstream portions 86 and 88 of the inboard wall structure 72 and outboard wall structure 74 which are joined by the bulkhead.

A downstream portion 90 of the inboard wall structure 72 is formed by an inner support ring 92 and an inner liner ring 94 outboard thereof (between the inner support ring and the main interior portion 94 of the combustor). The outboard wall structure 74, similarly, comprises an outer support ring 96 and an outer liner ring 98 inboard thereof. There is, thus, an inner gap 140 between the inner support ring and inner liner ring and an outer gap 142 between the outer support ring and outer liner ring.

The inner support ring 92 extends from a forward/upstream end/rim 100 to a downstream/aft end/rim 102 and has: a surface 104 which is an outer or exterior surface (viewed relative to the combustor interior 144) but is an inboard surface (viewed radially); and a surface 106 which is an inner or interior surface but an outboard surface. Similarly, the inner liner ring 94 has a forward/upstream end/rim 110, a downstream/aft end/rim 112, an inboard surface 114, and an outboard surface 116. Similarly, the outer support ring 96 has a forward/upstream end/rim 120, a downstream/aft end/rim 122, an inboard surface 124 (which is an inner/interior surface), and an outboard surface 126 (which is an outer/exterior surface). Similarly, the outer liner ring 98 has an upstream/forward end/rim 130, a downstream/aft end/rim 132, an inboard surface 134, and an outboard surface 136.

Exemplary support rings 92 and 96 are metallic (e.g., nickel-based superalloys). Exemplary liners are formed of CMCs such as silicon carbide reinforced silicon carbide (SiC/SiC) or silicon (Si) melt infiltrated SiC/SiC (MI SiC/SiC). The CMC may be a substrate atop which there are one or more protective coating layers or adhered/secured to which there are additional structures. The CMC may be formed with a sock weave fiber reinforcement including continuous hoop fibers.

Each of the exemplary vanes comprises a shell 180. The exemplary shell may be formed of a CMC such as those described above for the liners. The exemplary shell extends from an inboard end (rim) 182 to an outboard end (rim) 184 and forms an airfoil having a leading edge 186 and a trailing edge 188 and a pressure side 190 and a suction side 192 (FIG. 2). As is discussed further below, the shell has a plurality of outlet openings/holes 194 from the interior 196. The exemplary holes are generally along the trailing edge. Respective inboard and outboard end portions of the shell 180 pass at least partially through respective apertures 198 and 199 (FIG. 3) in the liners 94 and 98.

In operation, with operating temperature changes, there will be differential thermal expansion between various components, most notably between the CMC components and the metallic components. As temperature increases, the metallic support rings 92 and 96 will tend to radially expand so that their spacing may expand at a different rate and/or by a different ultimate amount than the radial dimension of the shell. An exemplary metal support ring has approximately three times the coefficient of thermal expansion as the CMC shell. However, in operation, the exemplary CMC shell is approximately three times hotter than the metal shell (e.g., 2.5-4 times). Thus, the net thermal expansion mismatch can be in either direction. This may cause the gaps 200 and 202 between the respective inboard end and outboard end of the shell and the adjacent surfaces 106 and 124 to expand or contract.

Accordingly, radially compliant means may be provided at one or both of the ends of the shell. The exemplary implementation involves radially compliant members 210 and 212 at respective inboard ends and outboard ends of the shells 180. For each vane, the exemplary member 210 is between the inboard end 182 and the support ring 92 whereas the exemplary member 212 is between the outboard end 184 and the support ring 96. The exemplary members 210 and 212 respectively circumscribe the associated ends 182 and 184 and are respectively at least partially accommodated in recesses 214, 216 in the associated surfaces 106, 124. The exemplary members 210 and 212 are held under compression. Exemplary means for holding the members 210 and 212 under compression comprise tensile members 220 (e.g., threaded rods) extending through the shell 180 from end to end and also extending through apertures 222 and 224 respectively in the support rings 92 and 96. End portions of the rods 220 may bear nuts or other fastening means to radially clamp the support rings 92 and 96 to each other and hold the shell 180 and members 210, 212 in radial compression.

Exemplary members 210 and 212 are canted coil springs. These are compressed transverse to the spring coil axis/centerline. Canted coil springs are commonly used for energizing seals. The canted coil spring provides robustness and the necessary spring constant for a relatively compliant or conformable seal material. However, by using the canted coil spring in the absence of the seal material (e.g., with each turn of the spring contacting the two opposing surfaces (vane rim and support ring)), an air flowpath may be provided through the spring (between turns of the spring) while allowing cooling air to pass into or out of the airfoil shell. As is discussed further below, this allows air to pass from the spaces 140, 142 through the canted coil springs and radially through the ends 182 and 184 into the vane interior 196 and, therefrom, out the outlets 194. Canted coil springs provide a relatively constant compliance force over a relatively large range of displacement compared with normal (axially compressed) coil springs of similar height. The exemplary canted coil spring materials are nickel-based superalloys. Alternative radially compliant members are wave springs (e.g., whose planforms correspond to the shapes of the adjacent vane shell ends 182, 184). Such wave springs may similarly be formed of nickel-based superalloys. As long as such a spring is not fully flattened, air may flow around the wave. Additionally, grooves or other passageways may be provided in the vane shell rims to pass airflow around the springs.

Other considerations attend the provision of the cooling airflows to pass through the canted coil springs. The exemplary bulkhead bears a circumferential array of nozzles 240 having air inlets 242 for receiving an inlet airflow 244 and having outlets 246 for discharging fuel mixed with such air 244 in a mixed flow 248 which combusts.

In a rich-quench-lean combustor, dilution air is introduced downstream. FIG. 3 shows introduction of an inboard dilution airflow 250 and an outboard dilution airflow 252. The respective airflows 250 and 252 are admitted via passageways 254, 256 in a respective inner (inboard) air inlet ring 260 and outer (outboard) air inlet ring 262. The exemplary rings 260 and 262 are metallic (e.g., nickel-based superalloy) and have outer/exterior inlets 270, 272 to the passageways 250, 252 and interior outlets 274, 276 from the passageways 254, 256. The exemplary rings 260, 262 are positioned to separate the bulkhead structure from the vane ring assembly downstream thereof.

The rings 260, 262 may have further passageways for introducing air to the spaces 140 and 142 and, forward thereof, the space 280 between a CMC inner layer 282 of the dome structure and a metallic outer layer 284. The inner layer 282 combines with the liner rings 94 and 98 to form a liner of the combustor; whereas the outer layer 284 combines with the support rings 92 and 96 to form a shell of the combustor.

In the exemplary implementation, the inner ring 260 has a passageway 320 for admitting an airflow 322 to the space 140 (becoming an inner airflow within/through the space 140). The passageways 320 each have an inlet 324 and an outlet 326. The exemplary inlets 324 are along the inboard face of the ring 260, whereas the outlets 326 are along its aft/downstream face. Similarly, the outboard ring 262 has passageways 350 passing flows 352 (becoming an outer airflow) into the space 142 and having inlets 354 and outlets 356. The exemplary inlets 354 are along the outboard face of the ring 262 and exemplary outlets 356 are along the aft/downstream face. Part of the flows 322, 352 pass through the respective canted coil springs 210, 212 as flows 360, 362. The remainder passes around the shells and passes toward the downstream end of the respective space 140, 142 which is blocked by a compliant gas seal 370, 372. Holes 374, 376 are provided in the liner rings 94, 98 to allow these remainders 378, 380 to pass into the downstream end of the combustor interior 144 downstream of the vanes.

The exemplary implementation, however, asymmetrically introduces air to the space 280. In the exemplary implementation, air is introduced through passageways 390 in the outboard ring 262 and passed into the combustor interior via passageways 392 in the inboard ring 260. This airflow 394 thus passes radially inward through the space 280 initially moving forward/upstream until it reaches the forward end of the space and then proceeding aft. This flow allows backside cooling of the CMC liner and entry of the cooling air into the combustion flow after this function is performed. Thus, in operation, the inner CMC liner handles the majority of thermal loads and stresses and the outer metal shell/support handles the majority of mechanical loads and stresses while cooling air flowing between these two controls material temperatures to acceptable levels.

Figure 6:
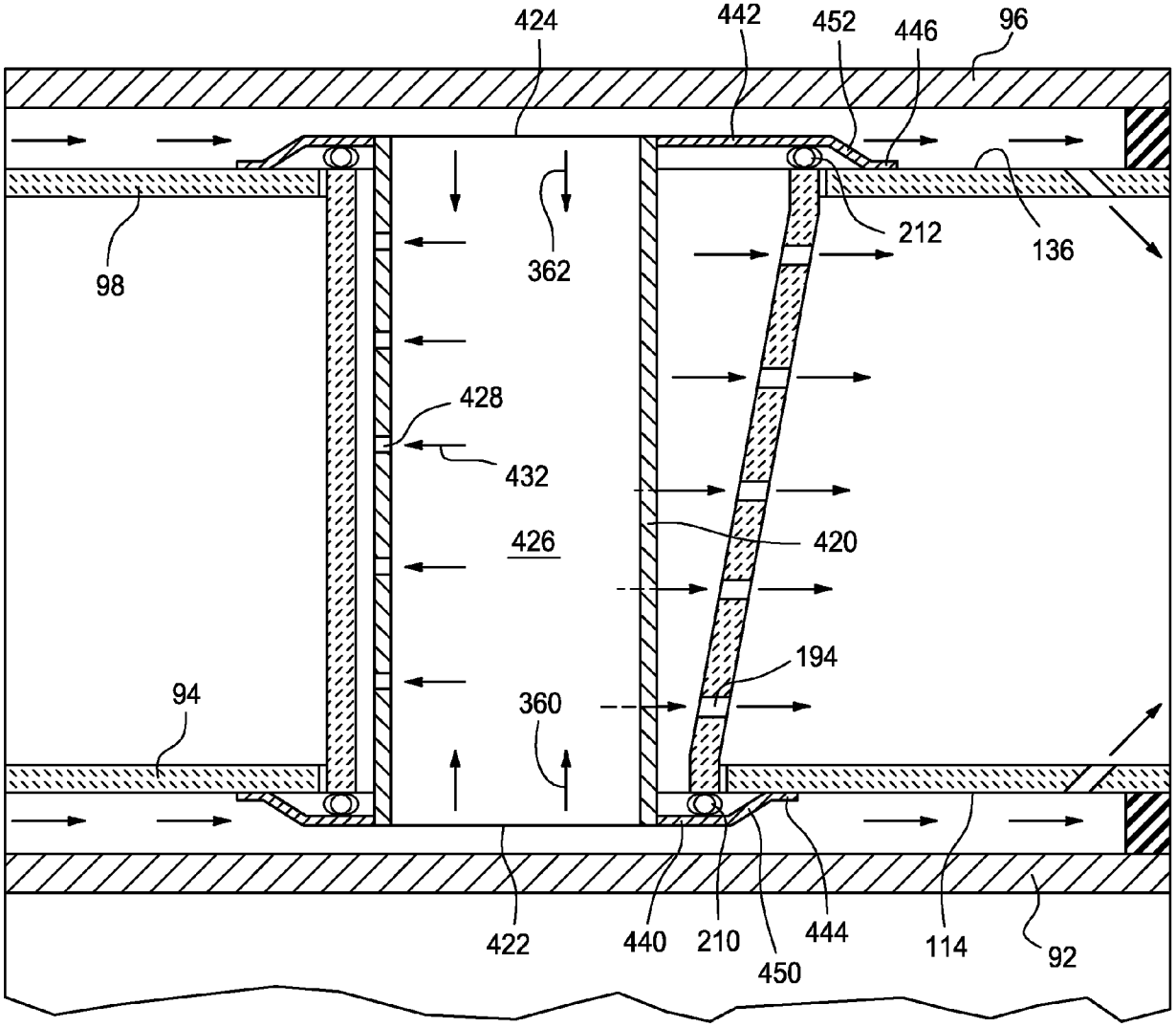
FIG. 6 is a partial axial sectional view of an alternate combustor.

FIG. 6 shows an alternate system wherein the shell is held to the liners 94, 98 relatively directly and only indirectly to the support rings 92 and 96. In this example, a hollow spar 420 extends spanwise through the shell from an inboard end 422 to an outboard end 424. The spar has an interior 426. A plurality of vent holes 428 extend from the spar interior 430 to the shell interior outside of the spar. The exemplary holes 428 are along a leading portion of the spar so that, when they pass an airflow 432 (resulting from the airflows 360 and 362) around the interior surface of the shell to exit the outlet holes 194, this may provide a more even cooling of the shell in high temperature applications. To secure the spar to the liners, exemplary respective inboard and outboard end portions of the spar are secured to brackets 440 and 442 (e.g., stamped or machined nickel superalloy brackets having apertures receiving the end portions and welded thereto). The exemplary brackets 440 and 442 have peripheral portions (flanges) 444 and 446 which engage the respective exterior surfaces 114 and 136. The flanges may be offset from main body portions of the brackets to create perimeter wall structures 450, 452 which retain the compliant members 210, 212. The exemplary compliant members may still be canted coil springs. However, in this example, only relatively small (if any) airflows pass through the turns of the springs.

One or more embodiments have been described. Nevertheless, it will be understood that various modifications may be made. For example, when implemented in the remanufacture of the baseline engine or the reengineering of a baseline engine configuration, details of the baseline configuration may influence details of any particular implementation. Accordingly, other embodiments are within the scope of the following claims.

What is claimed is:

1. A vane assembly comprising:
an outer support ring;
an inner support ring;
an outer liner ring;
an inner liner ring; and
a circumferential array of vanes, each having:
a shell extending from an inboard end to an outboard end and at least partially through a respective associated aperture in the inner liner ring and an associated aperture in the outer liner ring; and
at least one of:
an outer compliant member compliantly radially positioning the shell relative to the outer support ring; and
an inner compliant member compliantly radially positioning the shell relative to the inner support ring,
wherein:
each inner compliant member or each outer compliant member comprises a canted coil spring; and
for said each inner compliant member or each outer compliant member, there are flowpaths between turns of the canted coil spring to permit air to flow from a space between an associated one of the outer support ring and inner support ring and an associated one of the outer liner ring and inner liner ring into an interior of the associated vane.

2. The vane assembly of claim 1 wherein at least one of:
the outer compliant member is between the outboard end and the outer support ring; and
the inner compliant member is between the inboard end and the inner support ring.

3. The vane assembly of claim 1 wherein each vane further comprises:
a tensile member extending through the shell and coupled to the outer support ring and inner support ring to hold the shell under radial compression.

4. The vane assembly of claim 3 wherein each tensile member comprises a rod extending through associated apertures in the outer support ring and inner support ring.

5. The vane assembly of claim 1 wherein:
the other of said each inner compliant member and each outer compliant member comprises:
another spring.

6. The vane assembly of claim 5 wherein:
each another spring is a canted coil spring.

7. The vane assembly of claim 5 wherein:
each another spring lacks a seal body energized by said another spring.

8. The vane assembly of claim 5 wherein:
for said each inner compliant member or each outer compliant member, each canted coil spring is at least partially received in a recess in the inner support ring or outer support ring.

9. The vane assembly of claim 1 further comprising:
an outer gas seal between the outer support ring and the outer liner ring; and
an inner gas seal between the inner support ring and the inner liner ring.

10. The vane assembly of claim 9 wherein:
the outer gas seal is aft of the circumferential array of vanes; and
the inner gas seal is aft of the circumferential array of vanes.

11. The vane assembly of claim 1 wherein:
the outer support ring and the inner support ring each comprise a nickel-based superalloy.

12. The vane assembly claim 1 wherein:
each shell comprises a ceramic matrix composite.

13. The vane assembly of claim 1 wherein:
at least one of the inner liner ring and the outer liner ring comprise an integral full hoop.

14. A combustor comprising the vane assembly of claim 1 and further comprising:
a combustor shell including the outer support ring and the inner support ring; and
a combustor liner including the outer liner ring and the inner liner ring,
wherein:
the combustor shell and combustor liner each include an upstream dome portion; and a plurality of fuel injectors are mounted through the upstream dome portions of the combustor shell and the combustor liner.

15. A method for operating the combustor of claim 14, the method comprising:

passing an outer airflow between the outer support ring and the outer liner ring;

passing an inner airflow between the inner support ring and the inner liner ring; and diverting air from the outer airflow and the inner airflow into the each shell.

16. The method of claim 15 wherein:

at least some of the diverted air passes through the each canted coil spring between said turns of said canted coil spring.

17. The method of claim 15 wherein:

a further airflow passes through the upstream dome portions of the combustor shell and combustor liner passing from outboard to inboard and then into a combustor interior.

18. The method of claim 15 wherein:

in operation, the combustor liner handles a majority of thermal loads and stresses and the combustor shell handles a majority of mechanical loads and stresses while the inner airflow and outer airflow control material temperatures.

19. A vane assembly comprising:

an outer support ring;

an inner support ring;

an outer liner ring;

an inner liner ring; and a circumferential array of vanes, each having:

a shell extending from an inboard end to an outboard end and at least partially through an associated aperture in the inner liner ring and an associated aperture in the outer liner ring; and at least one of:

an outer compliant member compliantly radially positioning the shell relative to the outer support ring; and an inner compliant member compliantly radially positioning the shell relative to the inner support ring, wherein:

each inner compliant member or each outer compliant member comprises a canted coil spring; and for said each inner compliant member or each outer compliant member, said canted coil spring lacks a seal body energized by the canted coil spring.

20. The vane assembly of claim 19 wherein:

each shell comprises a ceramic matrix composite (CMC).

21. A vane assembly comprising:

an outer support ring;

an inner support ring;

an outer liner ring;

an inner liner ring; and a circumferential array of vanes, each having:

a shell extending from an inboard end to an outboard end and at least partially through an associated aperture in the inner liner ring and an associated aperture in the outer liner ring;

a compliant member being at least one of:

an outer compliant member compliantly radially positioning the shell relative to the outer support ring; and an inner compliant member compliantly radially positioning the shell relative to the inner support ring; and a tensile member extending under tension through the shell and coupled to the outer support ring and inner support ring to hold the shell and compliant member under radial compression, wherein there are flowpaths through the compliant member to permit air to flow from a space between an associated one of the outer support ring and inner support ring and an associated one of the outer liner ring and inner liner ring into an interior of the associated vane, and wherein the compliant member is a canted coil spring.

22. The vane assembly of claim 21 wherein:

the compliant member indirectly radially positions the shell relative to at least one of the inner liner ring and outer liner ring.

* * * * *